US008662794B2

(12) United States Patent
Atchley et al.

(10) Patent No.: US 8,662,794 B2
(45) Date of Patent: Mar. 4, 2014

(54) HELICAL PILE ADAPTER

(75) Inventors: Jacob C. Atchley, Columbia, MO (US); Shawn D. Downey, Columbia, MO (US); Bernard A. Steinkamp, Mexico, MO (US)

(73) Assignee: Hubbell Incorporated, Shelton, CT (US)

( * ) Notice: Subject to any disclaimer, the term of this patent is extended or adjusted under 35 U.S.C. 154(b) by 196 days.

(21) Appl. No.: 13/191,653

(22) Filed: Jul. 27, 2011

(65) Prior Publication Data

US 2013/0028666 A1 Jan. 31, 2013

(51) Int. Cl.
*E02D 5/00* (2006.01)

(52) U.S. Cl.
USPC ..... 405/232; 403/378; 403/379.5

(58) Field of Classification Search
USPC ..... 405/232, 250, 251; 403/322.2, 378, 403/379.5
See application file for complete search history.

(56) References Cited

U.S. PATENT DOCUMENTS

| | | | | |
|---|---|---|---|---|
| 3,377,077 | A | 4/1968 | Hollander | |
| 3,832,861 | A * | 9/1974 | Jahnke et al. | 52/127.5 |
| 4,580,795 | A * | 4/1986 | Burtelson et al. | 279/76 |
| 5,145,286 | A * | 9/1992 | Summers | 405/259.1 |
| 5,310,014 | A | 5/1994 | Mueller | |
| 6,050,740 | A | 4/2000 | Dziedzic | |
| 6,398,445 | B1 | 6/2002 | Matali Badia | |
| 6,575,656 | B2 | 6/2003 | Suh | |
| 7,188,684 | B2 * | 3/2007 | Nolan | 175/57 |
| 7,377,723 | B2 | 5/2008 | Nolan | |
| 7,407,021 | B2 | 8/2008 | Nolan | |
| 7,686,359 | B1 * | 3/2010 | Walker | 408/199 |
| 8,376,678 | B2 * | 2/2013 | Walker | 411/387.1 |

* cited by examiner

*Primary Examiner* — Benjamin Fiorello
(74) *Attorney, Agent, or Firm* — Marcus R. Mickney; Mark S. Bicks; Alfred N. Goodman

(57) ABSTRACT

An adapter for connecting a helical pile to a drive assembly includes a pin block connectable to the helical pile. A tool body has a first protrusion to receive the pin block to facilitate aligning the helical pile with the tool body. A locking member is movably connected to the tool body. The locking member is movable between an insertion position to allow insertion of the pin block and a locking position to lock the pin block in the tool body.

20 Claims, 13 Drawing Sheets

HELICAL PILE ADAPTER

FIELD OF THE INVENTION

The present invention relates to an adapter that quickly and easily connects to a helical pile. More particularly, the present invention relates to an adapter that facilitates alignment between a helical pile and a tool body to provide a quick and easy connection. Still more particularly, the present invention relates to an adapter in which a pin assembly is connected to a helical pile prior to connecting the helical pile to the drive tool.

BACKGROUND OF THE INVENTION

A pipe anchor or helical or screw pile is used as a building foundation. The helical pile is driven into the ground and carries the structure's load. Helical bearing plates connected to the shaft of the helical pile transfer the load to the soil. A drive tool connects the helical pile to a powered drive head to drive the helical pile into the ground.

An end of the helical pile has openings in the pipe wall that are aligned with openings in the drive tool such that a drive pin assembly can be inserted through the openings to secure the drive tool to the helical pile. The helical pile and the drive tool have circular cross sections, making aligning the openings of the helical pile and drive tool difficult. The helical pile must first be longitudinally aligned with the drive tool for inserting the helical pile in the drive tool. The inserted helical pile must then be rotated to align the openings of the helical pile with the openings of the drive tool. A drive pin assembly can then be inserted through the aligned openings to secure the helical pile to the drive tool. Accordingly, a need exists for a drive tool that can be quickly and easily connected to a helical pile.

Another problem associated with existing drive tools is that the drive tool is often high in the air already connected to the machinery powering the drive head. The cumbersome helical pile must then be lifted and manipulated into alignment with the drive tool. Once the openings are axially aligned, the helical pile is inserted in the drive tool. The helical pile must then be rotated to align the openings with those of the drive tool to receive the drive pin assembly. Manipulating the helical pile into axial and rotational alignment with the drive tool suspended in the air is a cumbersome and difficult task. Accordingly, a need exists for a drive tool in which a drive pin assembly can be connected to the helical pile before connecting to the drive tool, thereby facilitating connecting the helical pile to the drive tool.

SUMMARY OF THE INVENTION

Accordingly, a primary objective of the present invention is to provide an improved adapter for connecting a helical pile to a drive assembly.

A further objective of the present invention is to provide an improved adapter that facilitates aligning the helical pile with a drive tool of the adapter.

A further objective of the present invention is to provide an improved adapter in which a pin assembly is connected to a helical pile prior to connecting the helical pile to a drive tool.

A further objective of the present invention is to provide an improved adapter connectable to either a horizontally or vertically disposed helical pile.

The foregoing objectives are basically attained by an adapter for connecting a helical pile to a drive assembly includes a pin block connectable to the helical pile. A tool body has a first protrusion to receive the pin block to facilitate aligning the helical pile with the tool body. A locking member is movably connected to the tool body. The locking member is movable between an insertion position to allow insertion of the pin block and a locking position to lock the pin block in the tool body.

The foregoing objectives are also basically attained by an adapter for connecting a helical pile to a drive assembly including a pin block assembly connectable to the helical pile. The pin block assembly includes a first pin block and a second pin block. First and second pins connect the first pin block to the second pin block. The first and second pin blocks engage an outer surface of the helical pile. A tool body has first and second protrusions to receive the first and second pin blocks to facilitate aligning the helical pile with the tool body. First and second locking members are movably connected to the tool body. The first and second locking members are movable between an insertion position to allow insertion of the first and second pin blocks and a locking position to lock the first and second pin blocks in the tool body.

The foregoing objectives are also basically attained by a method of connecting a tool body to a helical pile. A pin block is connected to the helical pile. The helical pile is inserted in the tool body. The helical pile is locked in the tool body with a locking member.

Other objects, advantages and salient features of the invention will become apparent from the following detailed description, which, taken in conjunction with the annexed drawings, discloses a preferred embodiment of the invention.

As used in this application, the terms "front," "rear," "upper," "lower," "upwardly," "downwardly," and other orientational descriptors are intended to facilitate the description of the helical pile adapter, and are not intended to limit the structure of the helical pile adapter to any particular position or orientation.

BRIEF DESCRIPTION OF THE DRAWINGS

The above aspects and features of the present invention will be more apparent from the description for an exemplary embodiment of the present invention taken with reference to the accompanying drawings, in which.

Throughout the drawings, like reference numerals will be understood to refer to like parts, components and structures.

DETAILED DESCRIPTION OF EXEMPLARY EMBODIMENT

As shown in FIGS. 1-13, an exemplary embodiment of the present invention includes an adapter 111 for connecting a helical pile 101 to a drive assembly (not shown). The adapter 111 includes a tool body 121 and a pin assembly 141. The adapter 111 is described below with reference to a right circular cylindrical helical pile 101, although the adapter may be configured for use with any shape helical pile.

Figure 1:
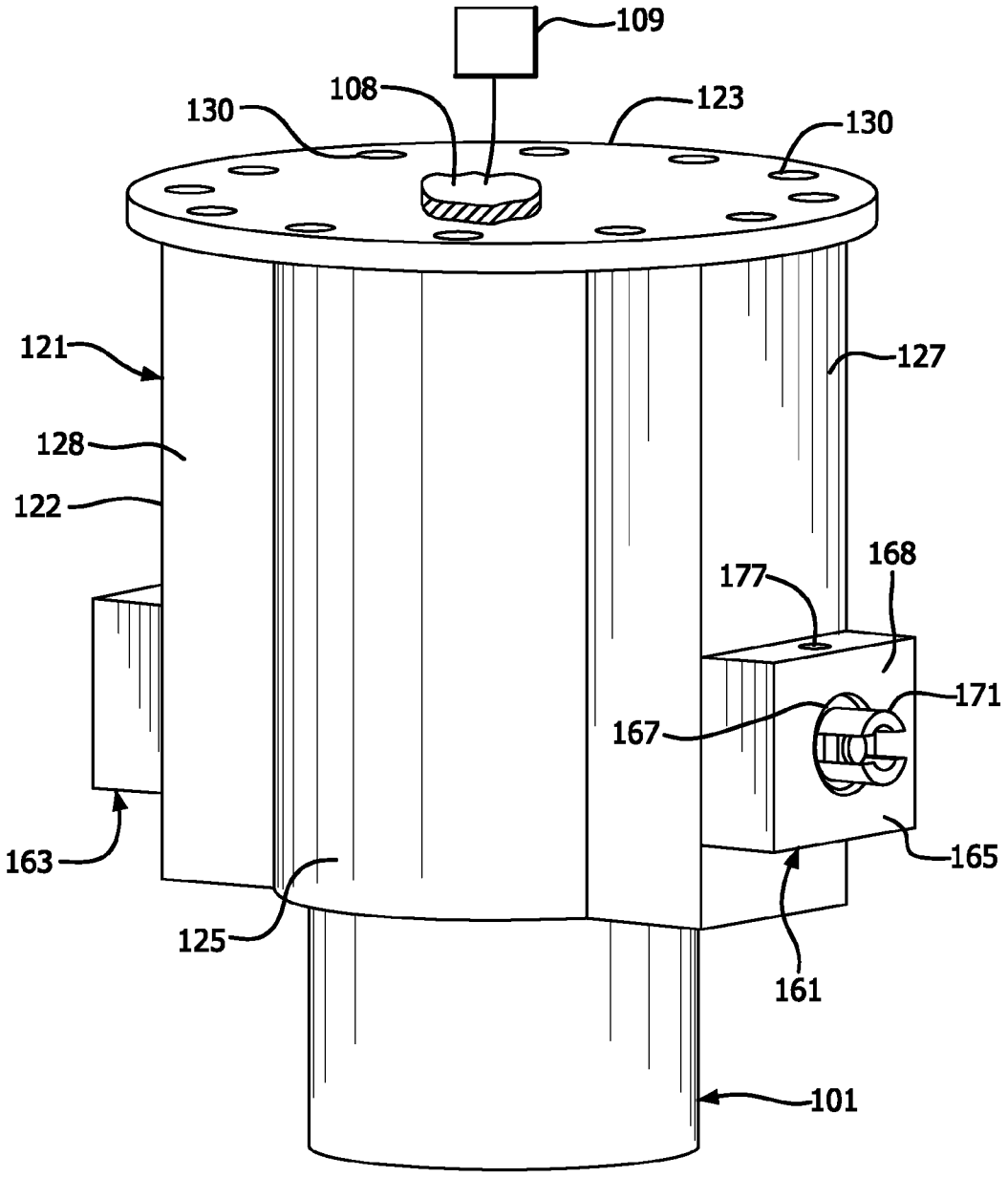
FIG. 1 is a perspective view of a helical pile connected to a drive tool in accordance with an exemplary embodiment of the present invention.
Figure 2:
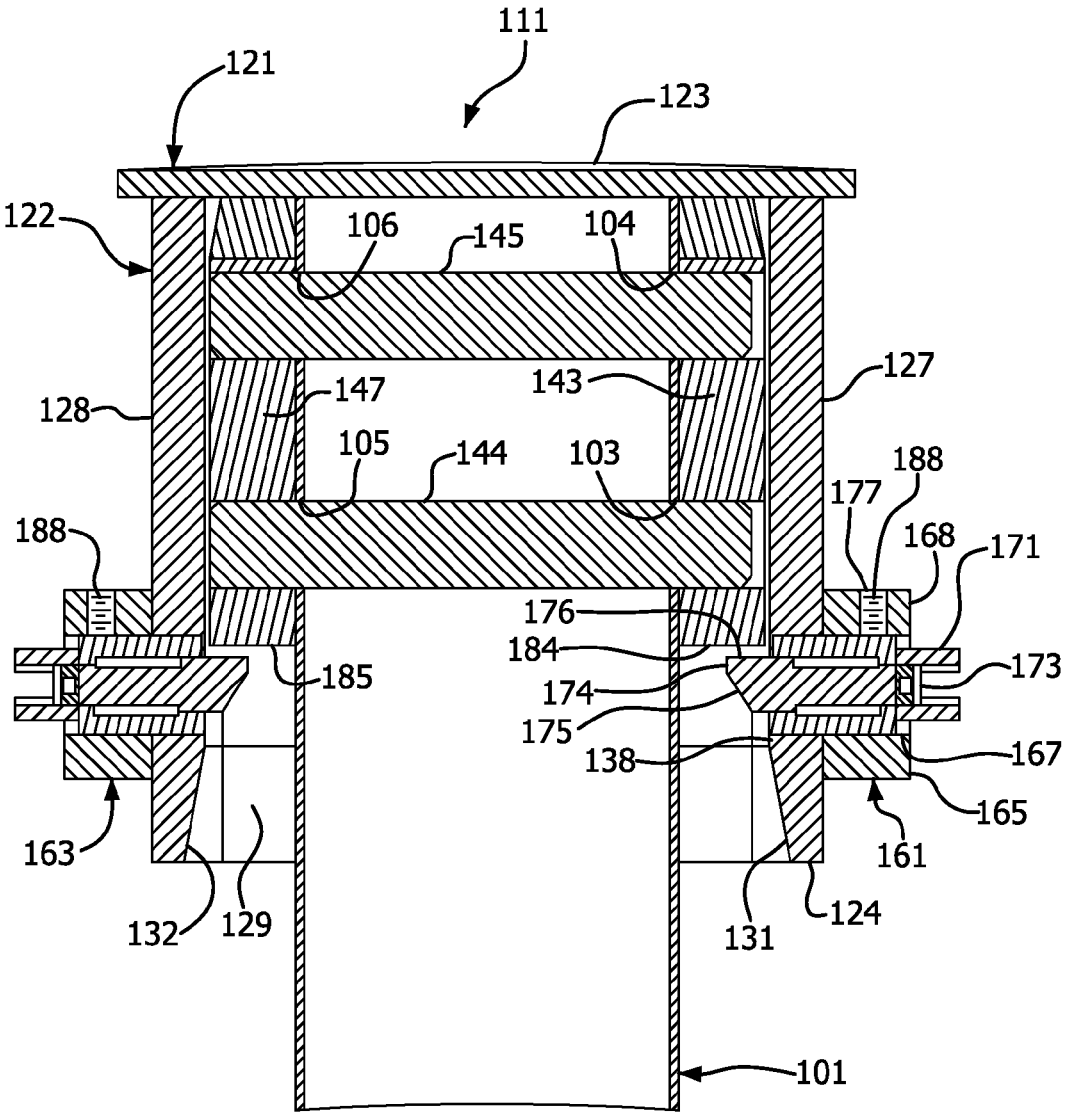
FIG. 2 is an elevational view in cross section of the anchor pipe connected to the drive tool of FIG. 1.

The tool body 121 has a wall 122 extending downwardly from a flange 123, as shown in FIGS. 1-6. The wall preferably has first and second substantially arcuate portions 125 and 126 that are oppositely convex. First and second substantially rectangularly-shaped protrusions 127 and 128 are formed between and join the first and second substantially arcuate portions 125 and 126. A cavity 129 is formed by the wall 122 and the flange 123 within the tool body 121. Inner surfaces 131 and 132 of the protrusions 127 and 128 proximal a free end 124 of the wall 122 preferably taper inwardly, as shown in FIG. 2.

The flange 123 has a plurality of bolt holes 130 to receive fasteners to secure the adapter 111 to a flange 108 of a drive assembly 109. The drive assembly includes a drive head connected to and powered by machinery. The adapter 111 transfers the rotation of the drive head to the helical pile 101.

First and second locking dog assemblies 161 and 163 are connected to the first and second protrusions 161 and 163, as shown in FIG. 2. The first and second locking dog assemblies 161 and 163 are substantially identical. The first locking dog assembly 161 includes a housing 165 having an opening 167 passing from an outer surface 168 of the locking dog to an inner surface 138 of the tool body wall 122. Preferably, the opening 167 is substantially perpendicular to a longitudinal axis of the helical pile 101. A locking member 171 is axially and rotatably movable in the opening 167. The locking member 171 is movable between an insertion position and a locking position. A spring member 173 biases the locking member 171 toward the locking position, as shown in FIG. 2, in which a free end 174 of the locking member 171 extends into the cavity 129. In the insertion position, the locking member 171 is withdrawn from the cavity 129 to allow insertion of the pin assembly 141.

The free end 174 of the locking member 171 has a sloped surface 175. The sloped surface 175 extends upwardly and radially into the cavity 129 to allow the pin assembly 141 to pass the locking member 171 during insertion of the helical pile 101. An upper surface 176 of the locking member 171 prevents an installed pin assembly 141 from moving the locking member and accidentally separating from the tool body 121. An opening 177 substantially perpendicular to the locking member opening 167 receives a set screw 188 to further prevent movement of the locking member 171 after a pin assembly 141 is installed.

Figure 9:
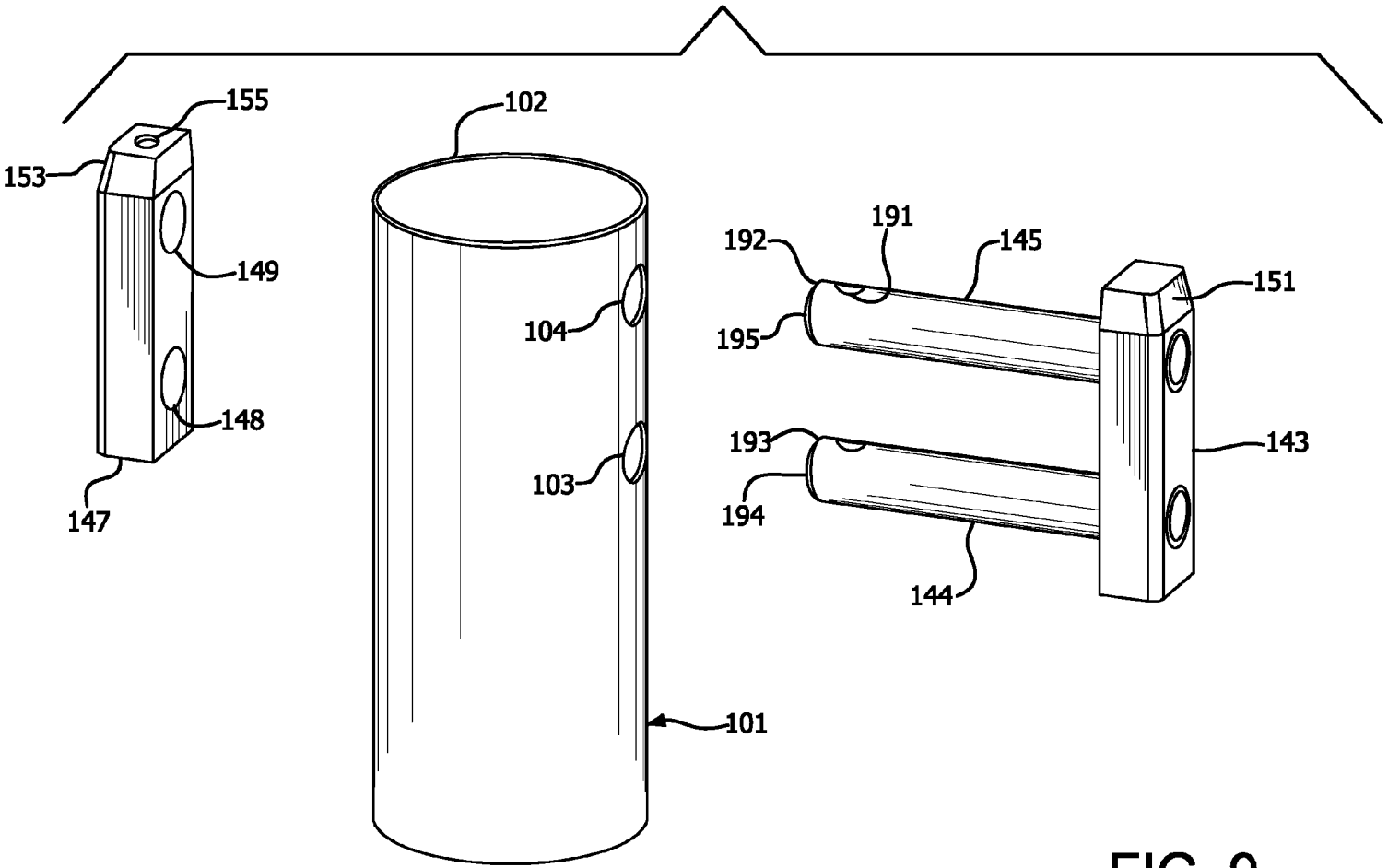
FIG. 9 is an exploded perspective view of the drive pin assembly prior to being connected to the helical pile of FIG. 8.
Figure 10:
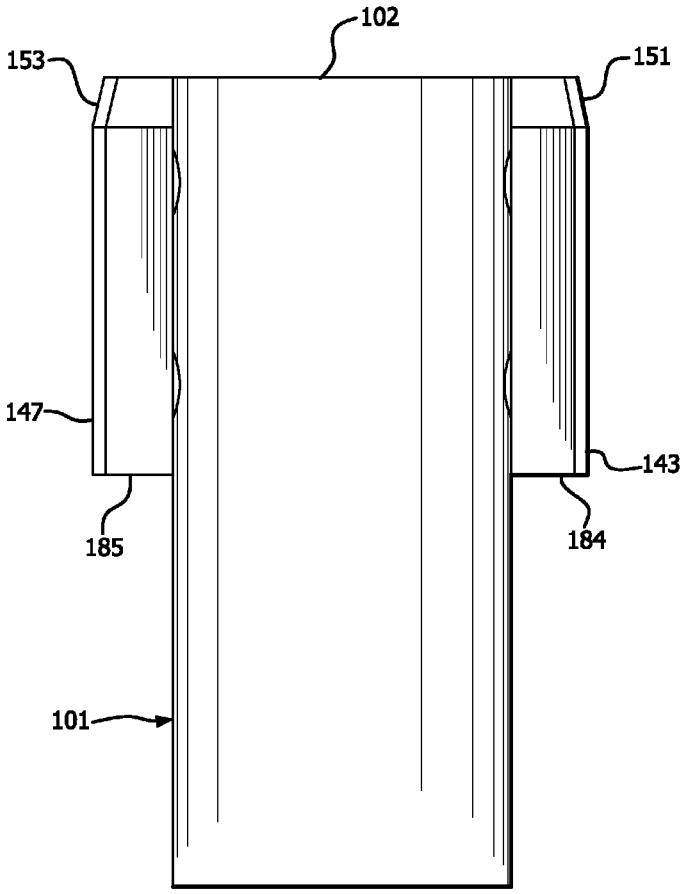
FIG. 10 is a front elevational view of the drive pin assembly connected to the helical pile of FIG. 8.
Figure 11:
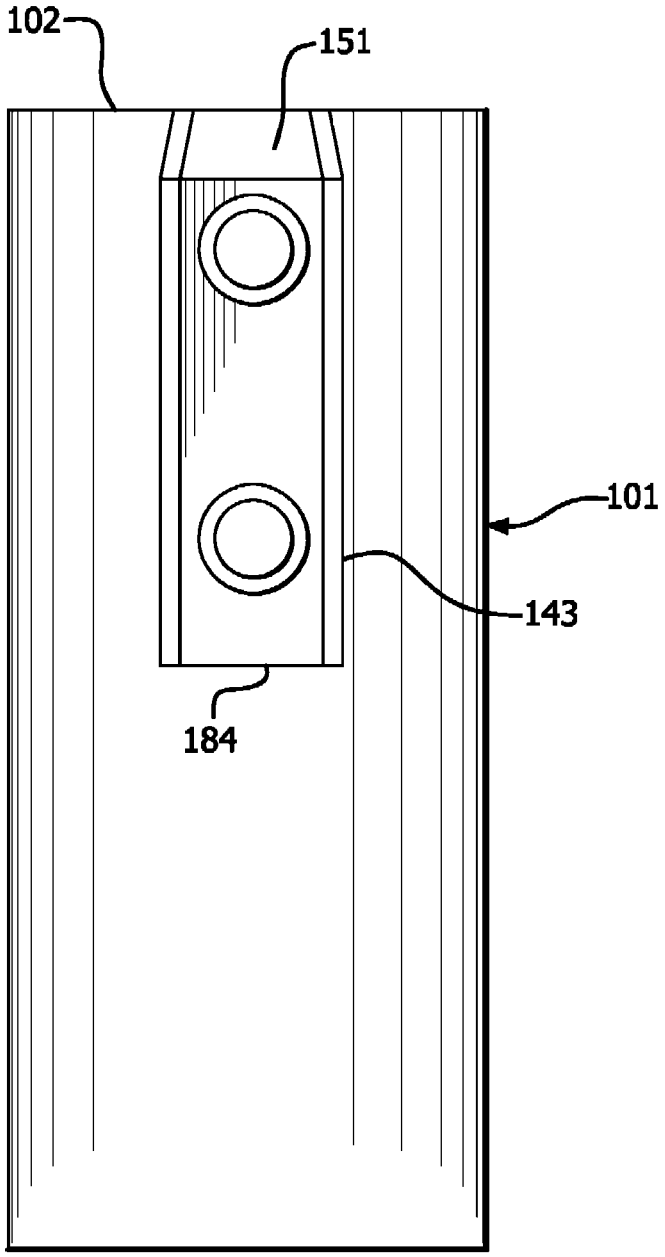
FIG. 11 is a side elevational view of the drive pin assembly connected to the helical pile of FIG. 8.
Figure 12:
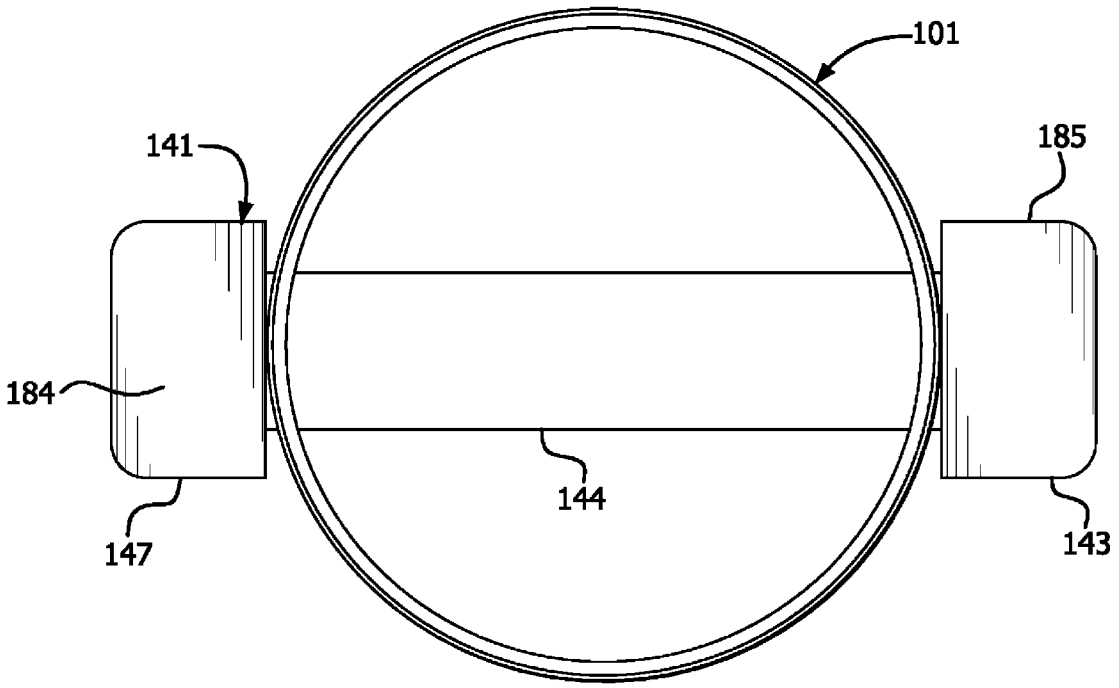
FIG. 12 is a bottom plan view of the drive pin assembly connected to the helical pile of FIG. 8.
Figure 13:
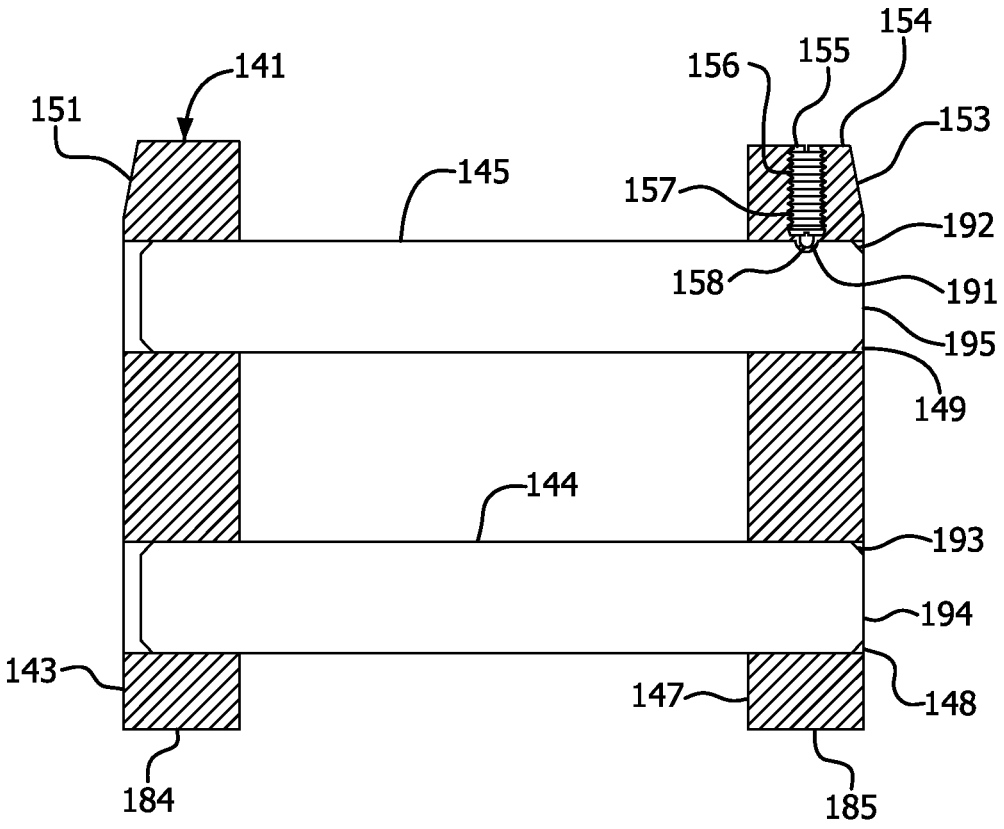
FIG. 13 is a side elevational view in cross section of the drive pin assembly connected to the helical pile of FIG. 8.

The pin assembly 141 includes a first pin block 143 having first and second pins 144 and 145 extending outwardly therefrom, as shown in FIGS. 2, 9 and 13. Fixed ends of the pins 144 and 145 are preferably welded to the first pin block 143, as shown in FIG. 9. Free ends 198 and 199 of the pins 144 and 145 pass through the openings 103, 104, 105 and 106 in the helical pile 101 and are received by corresponding openings 148 and 149 in a second pin block 147. The second pin block 147 has first and second openings 148 and 149 to receive the first and second pins 144 and 145, as shown in FIGS. 2 and 9. A detent 191 is formed in the second pin 145 to receive a ball plunger 157 of the second pin block 147, as shown in FIG. 13. Sloped surfaces 192 and 193 are formed at free ends 194 and 195 of the first and second pins 144 and 145 to facilitate insertion of the first and second pins in the second pin block 147.

First and second pin blocks 143 and 147 have sloped surfaces 151 and 153 to engage the sloped surfaces 175 of the locking members 171. An opening 155 extends downwardly from an upper surface 154 of the second pin block 147 to the second opening 149, as shown in FIG. 13. A spring member 156 and a ball plunger 157 are disposed in the opening 155. The spring member 156 biases the ball plunger 157 downwardly such that a ball 158 at a free end of the ball plunger extends into the opening 149 in the second pin block 147.

The helical pile 101 is typically made of carbon steel. The tool body 121 and the pin assembly 141 are preferably made of steel, such as A36 or 4140 steel.

Assembly and Operation

The adapter 111 in accordance with an exemplary embodiment of the present invention provides a quick and easy connection between the helical pile 101 and the drive assembly that does not require excessive manipulation to ensure proper alignment between the helical pile 101 and the tool body 121.

The adapter 111 can be connected to a helical pile 101 with the helical pile in either a horizontal or vertical position. The first and second pins 144 and 145 of the pin assembly 141 are passed through openings 103, 104, 105 and 106 in the helical pile, as shown in FIGS. 2 and 9. The second pin block 147 is then connected to the free ends 194 and 195 of the pins 144 and 145. The sloped surface 192 at the free end 195 of the second pin 145 pushes the ball plunger 156 upwardly as the second pin 145 passes through the opening 149. When the second pin 145 is completely installed in the opening 149, the spring member 156 urges the ball plunger 157 downwardly such that the ball 158 of the ball plunger 157 is received in the detent 191 in the second pin 145 to securely retain the second pin block 147 on the pins 144 and 145. The pin assembly 141 is connected to the helical pile 101 such that the sloped surfaces 151 and 153 of the pin blocks 143 and 147 are proximal an end 102 of the helical pile 101 to be inserted in the tool body 121, as shown in FIGS. 3, 8, 10 and 11. Because the pin assembly 141 is connected to the helical pile 101 prior to connecting the tool body 121, the longitudinal (axial) and rotational alignment problems associated with aligning helical piles with existing tool bodies are substantially prevented.

Figure 3:
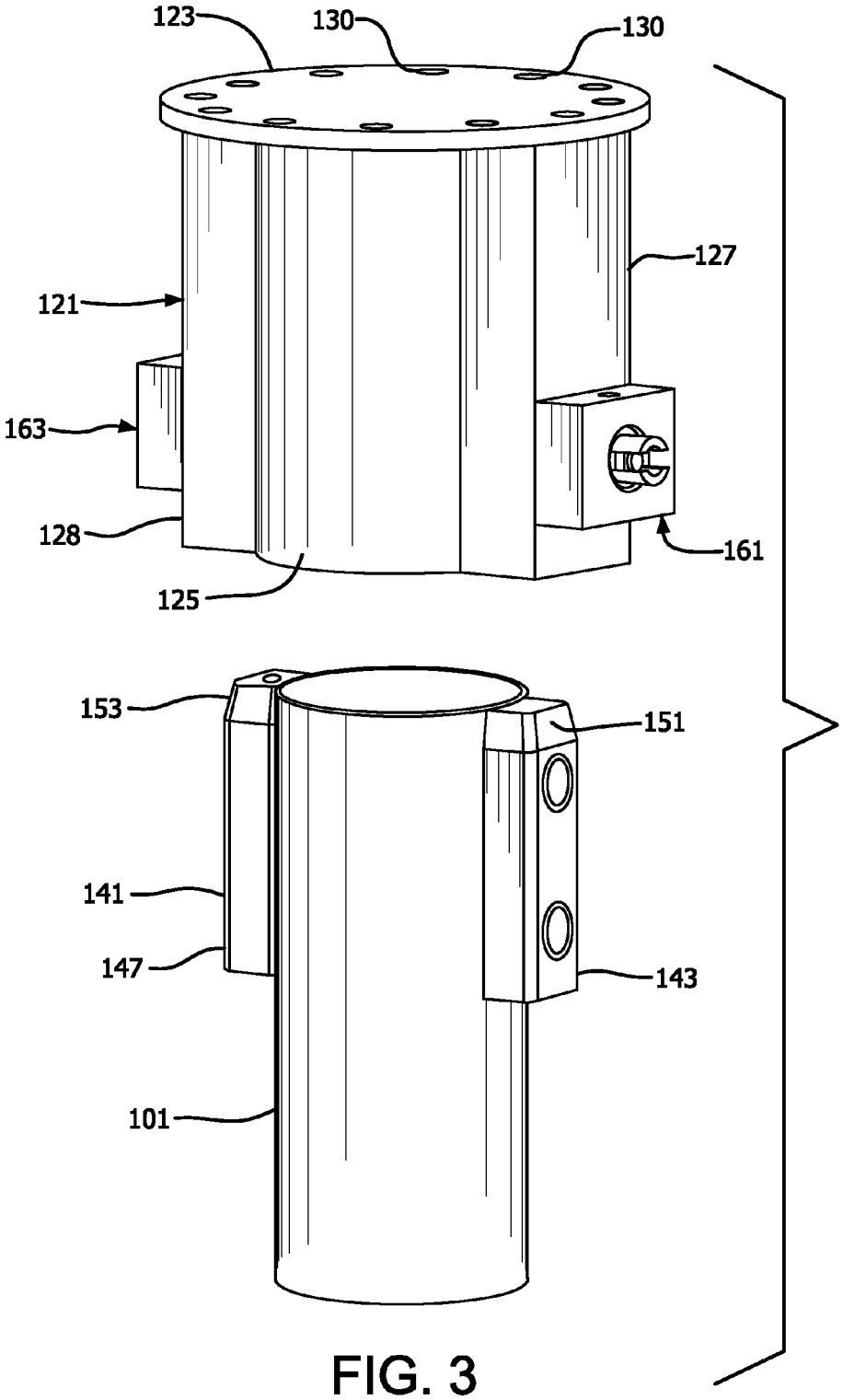
FIG. 3 is an exploded perspective view of the drive tool prior to being connected to the helical pile.
Figure 4:
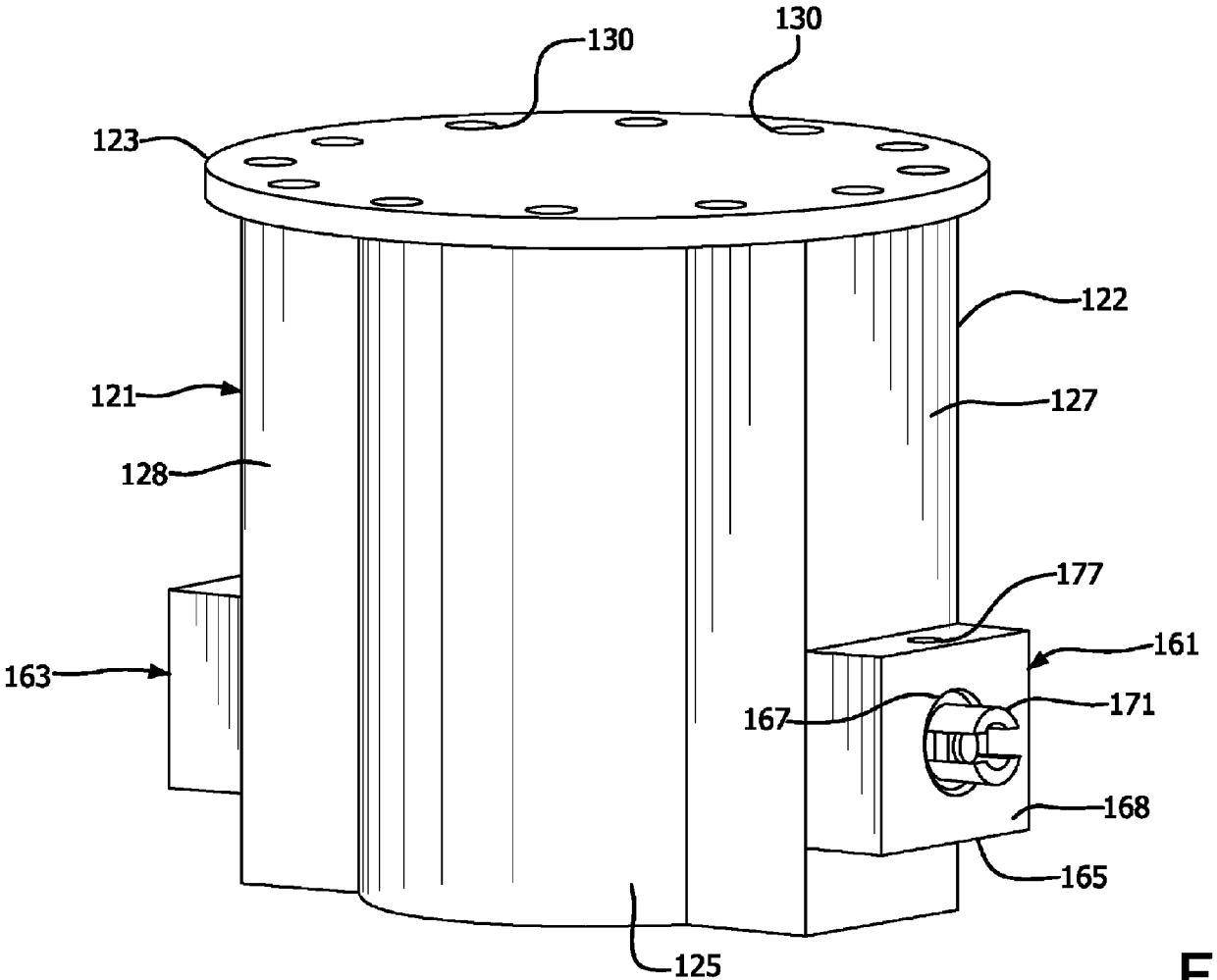
FIG. 4 is a perspective view of the drive tool of FIG. 1.
Figure 5:
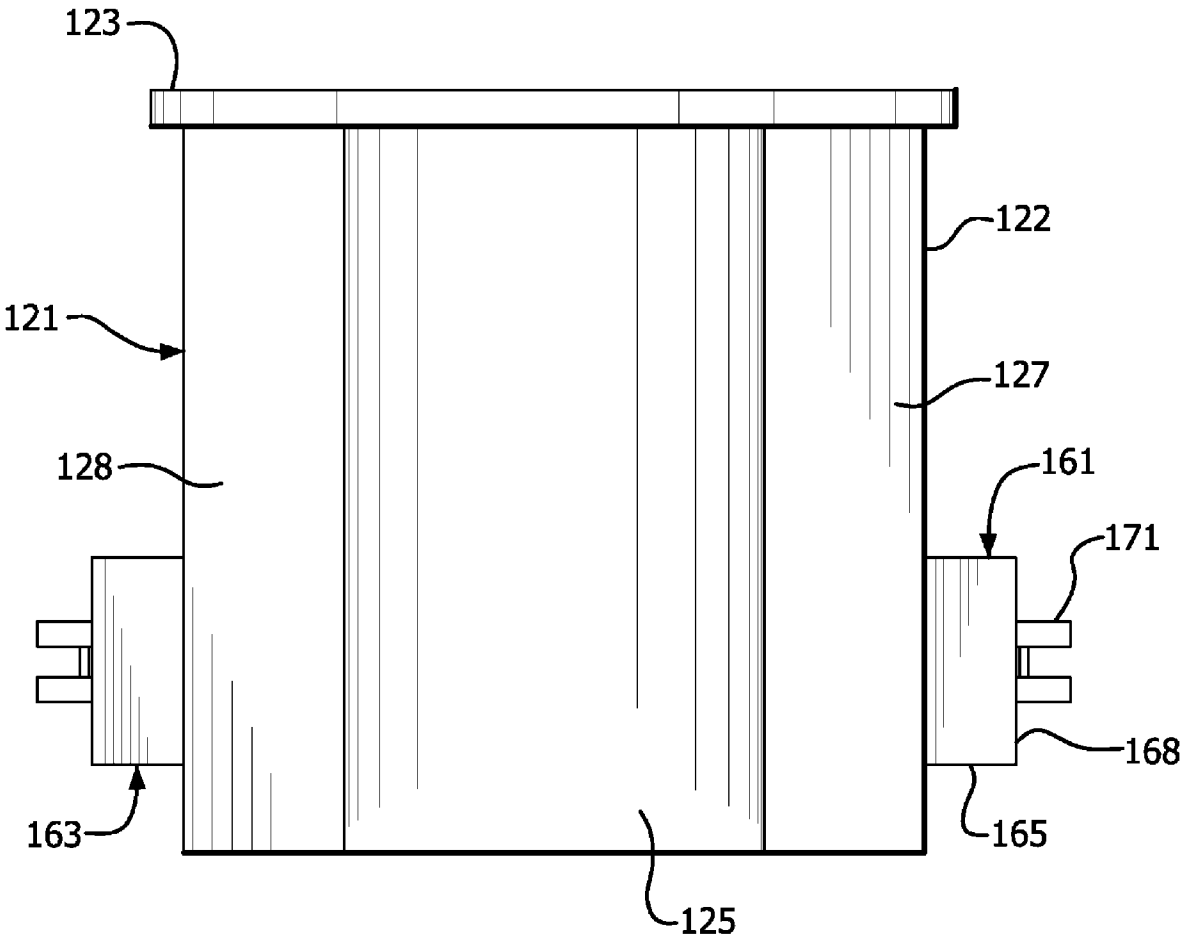
FIG. 5 is a front elevational view of the drive tool of FIG. 4.
Figure 6:
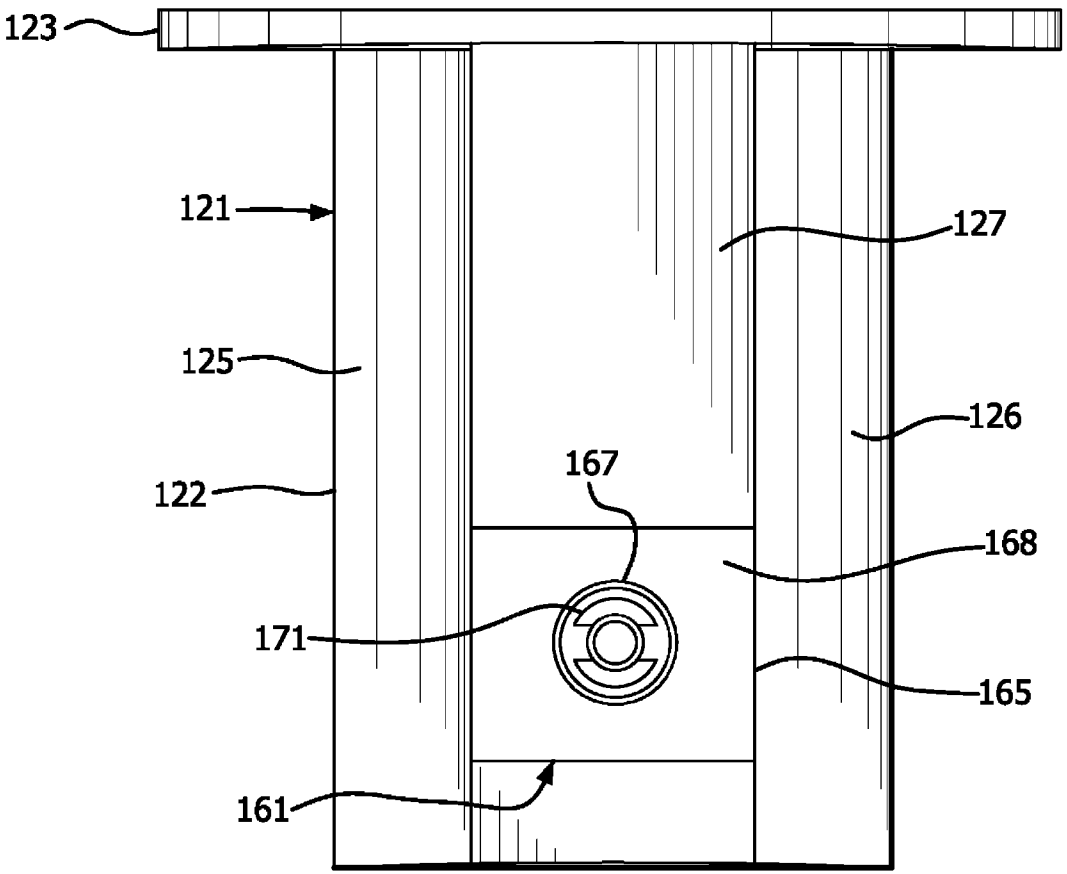
FIG. 6 is a side elevational view of the drive tool of FIG. 4.
Figure 7:
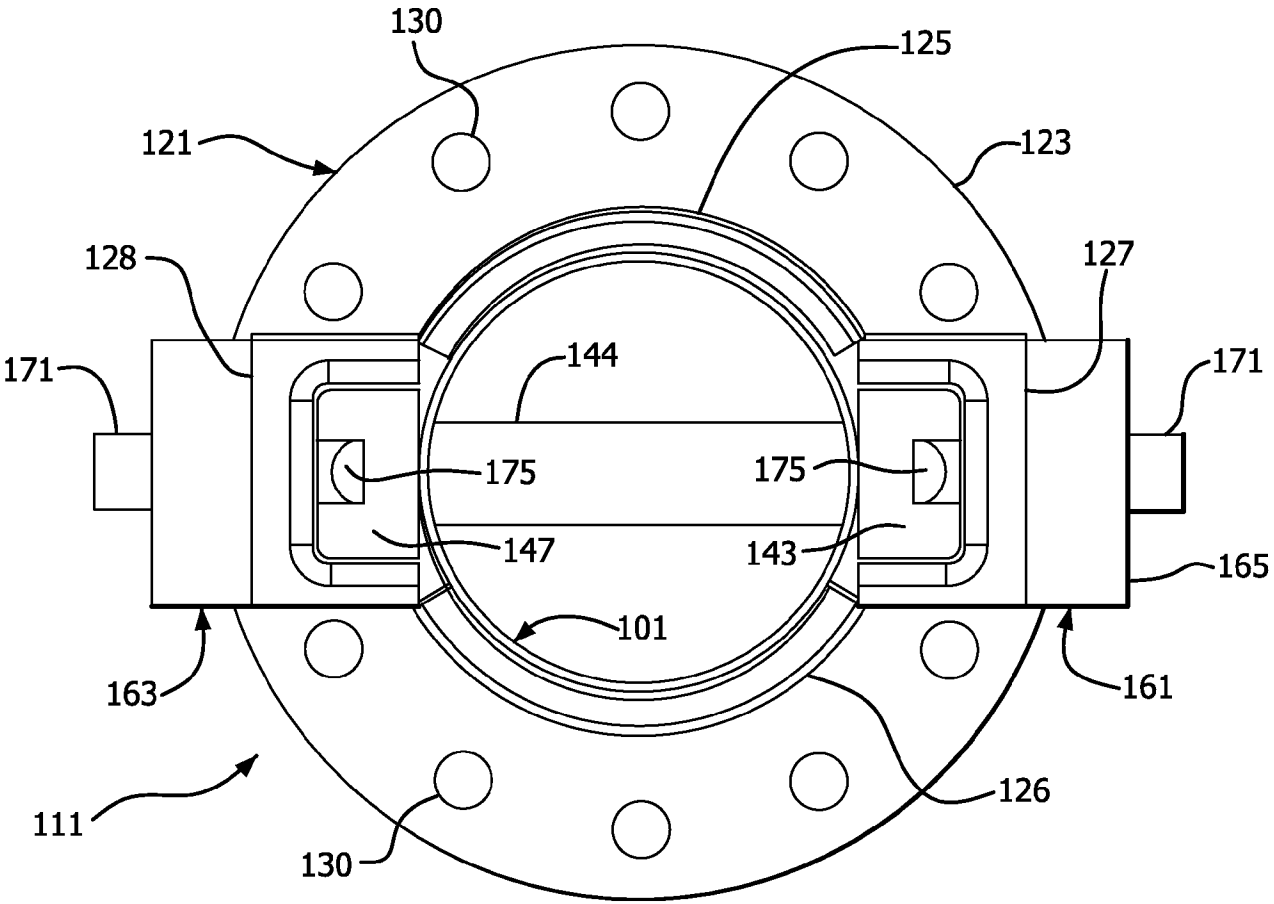
FIG. 7 is a bottom plan view of the drive tool of FIG. 4.
Figure 8:
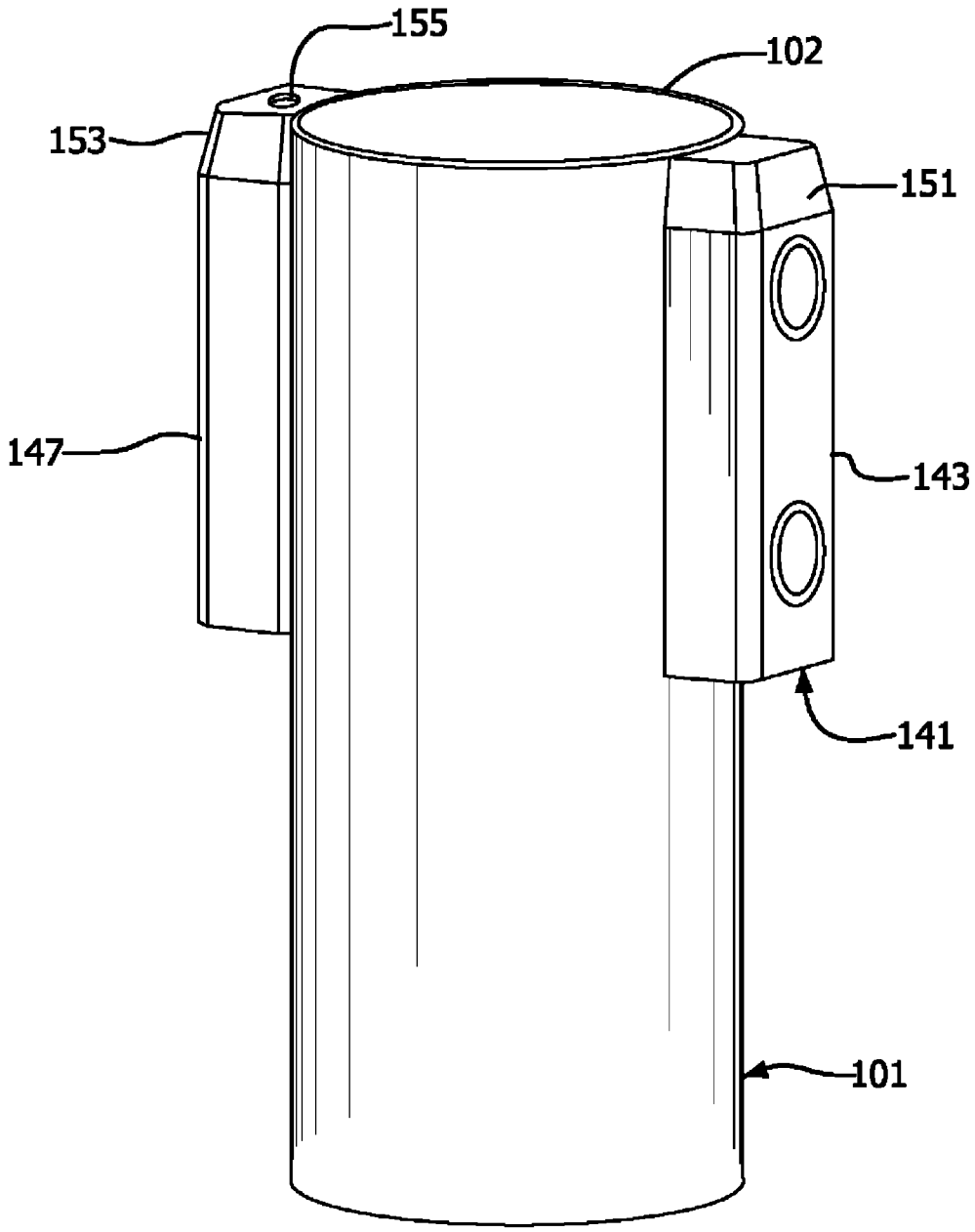
FIG. 8 is a perspective view of the drive pin assembly connected to a helical pile of FIG. 1.

The helical pile 101 and pin assembly 141 are then inserted in the tool body 121, as shown in FIGS. 2 and 3. The protrusions 127 and 128 of the tool body 121 receive the first and second pin blocks 143 and 147 of the pin assembly. The corresponding shapes of the pin blocks 143 and 147 and the protrusions 127 and 128 facilitate simply and quickly aligning the helical pile 101 with the tool body 121. The sloped surfaces 151 and 153 of the pin blocks 143 and 147 engage the sloped surfaces 175 of the locking members 171 of the locking assemblies 161 and 163, thereby causing the locking members to retract to allow the pin assembly 141 to pass the locking members. After the first and second pin blocks 143 and 147 have passed the locking members 171, the spring members 173 urge the locking members to move back into the cavity 129 of the tool body 121. Lower surfaces 184 and 185 of the first and second pin blocks 143 and 147 abut upper surfaces 176 of the locking members 171, thereby securely retaining the pin assembly 141 within the cavity 129 of the tool body 121. Accordingly, the helical pile 101 is substantially prevented from accidentally being removed from the tool body 121. The flange 123 of the tool body 121 can now be fastened to a corresponding flange of the drive assembly.

The locking members 171 can be rotated such that the sloped surfaces 175 face upwardly, thereby allowing the pin blocks 143 and 147 of the pin assembly 141 to be withdrawn from the tool body 121. A handle can be attached to an end of the locking member extending beyond the outer surface 168 of the housing 165 to enable rotation of the locking member. Alternatively, the locking members 171 can be locked in a withdrawn position to allow the pin blocks to be withdrawn. The locking member 171 can be keyed to the opening 167 such that the locking member can be locked in the withdrawn position. The locked position can also be used to insert the pin assembly in the cavity of the tool body 121. After the pin assembly 141 has been fully inserted, the locking members are unlocked from the withdrawn position such that the upper surfaces 176 of the locking members retain the pin blocks 143 and 147 in the tool body cavity 129.

While an advantageous embodiment has been chosen to illustrate the invention, it will be understood by those skilled in the art that various changes and modifications may be made therein without departing from the scope of the invention as defined in the appended claims.

What is claimed is:

1. An adapter for connecting a helical pile to a drive assembly, comprising:

a pin block connected to and extending radially outwardly from an outer surface of the helical pile;

a tool body having a first hollow protrusion to receive said pin block to facilitate rotationally aligning the helical pile with said tool body; and a locking member movably connected to said tool body, said locking member being movable between an insertion position to allow insertion of said pin block and a locking position to lock said pin block in said tool body, a lower radially extending surface of said pin block engaging said locking member when said locking member is in said locking position to prevent removal of said pin block from said tool body.

2. The adapter according to claim 1, wherein a flange is connected to said tool body and is connectable to the drive assembly.

3. The adapter according to claim 1, wherein an inner surface of said tool body proximal an open end is tapered to facilitate insertion of said pin block.

4. The adapter according to claim 1, wherein said pin block has a tapered first end to facilitate moving said locking member to said insertion position when inserting said pin block in said tool body.

5. The adapter according to claim 1, wherein said pin block is made of steel.

6. The adapter according to claim 1, wherein said tool body is made of steel.

7. The adapter according to claim 1, wherein a spring member biases said locking member in said locked position.

8. An adapter for connecting a helical pile to a drive assembly, comprising:

a pin block assembly connectable to the helical pile, said pin block assembly including a first pin block;

a second pin block; and first and second pins connecting said first pin block to said second pin block, said first and second pin blocks engaging an outer surface of the helical pile;

a tool body having first and second protrusions to receive said first and second pin blocks to facilitate aligning the helical pile with said tool body; and first and second locking members movably connected to said tool body, said first and second locking members being movable between an insertion position to allow insertion of said first and second pin blocks and a locking position to lock said first and second pin blocks in said tool body.

9. The adapter according to claim 8, wherein a flange is connected to said tool body and is connectable to the drive assembly.

10. The adapter according to claim 8, wherein an inner surface of said tool body proximal an open end is tapered to facilitate insertion of said first and second pin blocks.

11. The adapter according to claim 8, wherein said first and second pin blocks have tapered first ends to facilitate moving said first and second locking members to said insertion position when inserting said first and second pin blocks in said tool body.

12. The adapter according to claim 8, wherein said pin block is made of steel.

13. The adapter according to claim 8, wherein said tool body is made of steel.

14. The adapter according to claim 8, wherein spring members bias said first and second locking members in said locked positions.

15. The adapter according to claim 8, wherein said second pin block has a ball plunger received by a detent in said second pin to secure said second pin block to said second pin.

16. The adapter according to claim 15, wherein a spring member biases said ball plunger into a position engaging said ball plunger with said detent in said second pin.

17. A method of connecting a tool body to a helical pile, comprising the steps of connecting a pin block to an outer surface of the helical pile;

inserting the helical pile in the tool body; and locking the helical pile in the tool body with a locking member such that a lower radially extending surface of the pin block engages the locking member to prevent removal of the pin block from the tool body.

18. The method of connecting a tool body to a helical pile according to claim 17, wherein the pin block is connected to the helical pile before inserting the helical pile in the tool body.

19. The method of connecting a tool body to a helical pile according to claim 17, wherein the pin block is connected to the helical pile when the helical pile is either horizontal or vertical.

20. The method of connecting a tool body to a helical pile according to claim 17, further comprising retracting the locking member to remove the tool body from the helical pile.

* * * * *